US010493411B2

(12) United States Patent
Keller et al.

(10) Patent No.: US 10,493,411 B2
(45) Date of Patent: Dec. 3, 2019

(54) STIRRING DEVICE

(71) Applicant: EKATO Rühr-und Mischtechnik GmbH, Schopfheim (DE)

(72) Inventors: Wolfgang Keller, Sierentz (FR); Nicole Rohn, Rheinfelden (DE); Benjamin Multner, Wehr (DE)

(73) Assignee: EKATO Rühr-und Mischtechnik GmbH, Schopfheim (DE)

( * ) Notice: Subject to any disclaimer, the term of this patent is extended or adjusted under 35 U.S.C. 154(b) by 0 days.

(21) Appl. No.: 15/326,558

(22) PCT Filed: Jul. 16, 2015

(86) PCT No.: PCT/EP2015/066315
§ 371 (c)(1),
(2) Date: Jan. 16, 2017

(87) PCT Pub. No.: WO2016/012348
PCT Pub. Date: Jan. 28, 2016

(65) Prior Publication Data

US 2017/0197190 A1 Jul. 13, 2017

(30) Foreign Application Priority Data

Jul. 25, 2014 (DE) ..... 10 2014 110 542

(51) Int. Cl.
*B01F 7/00* (2006.01)
*B01F 7/16* (2006.01)

(52) U.S. Cl.
CPC ..... *B01F 7/00016* (2013.01); *B01F 7/00291* (2013.01); *B01F 7/00633* (2013.01); *B01F 7/167* (2013.01); *B01F 2215/0422* (2013.01)

(58) Field of Classification Search
CPC ..... B01F 7/00016; B01F 7/00291; B01F 7/00316; B01F 7/00633; B01F 7/167
(Continued)

(56) References Cited

U.S. PATENT DOCUMENTS 4,468,130 A * 8/1984 Weetman ..... B01F 7/00341 366/330.2
4,721,394 A * 1/1988 Casto ..... B01F 7/00341 366/330.2
(Continued)

FOREIGN PATENT DOCUMENTS

DE 21 03 732 A1 10/1972
DE 30 13 663 C2 10/1981
(Continued)

OTHER PUBLICATIONS

International Search Report dated Oct. 27, 2015 issued in the corresponding international application No. PCT/EP/2015/066315.
(Continued)

*Primary Examiner* — Tony G Soohoo
(74) *Attorney, Agent, or Firm* — Posz Law Group, PLC

(57) ABSTRACT

A stirring device, in particular an axially conveying stirring device, is proposed for stirring, mixing, homogenizing, dispersing and/or suspending in particular abrasive media, with at least one stirring blade which is configured to rotate about a rotary axis, and with a contour unit which is configured for reducing wear-down of the at least one stirring blade.

17 Claims, 2 Drawing Sheets

Figure 1:
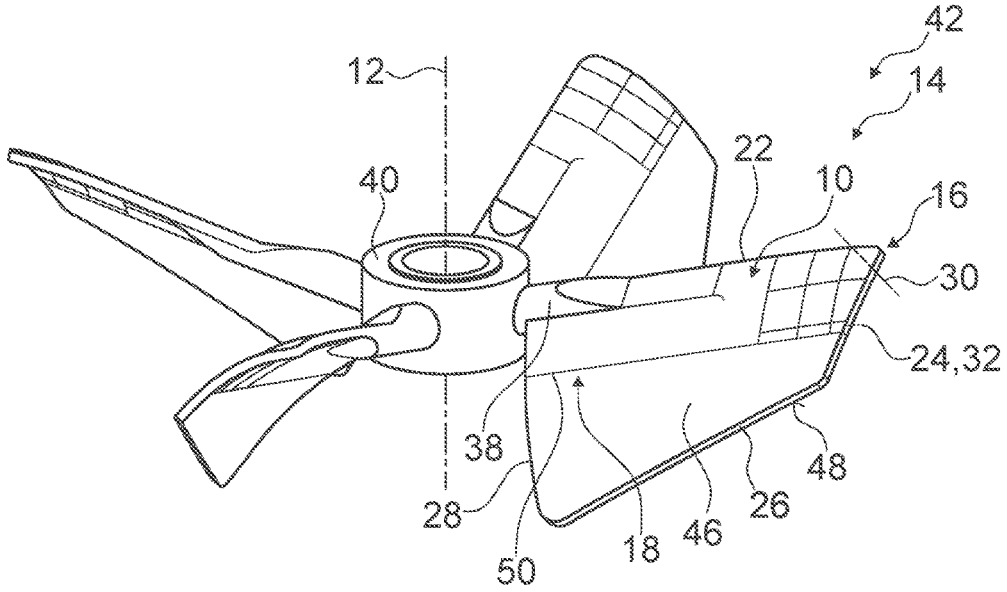

(58) Field of Classification Search
USPC ..... 366/279, 290–300, 325.1–325.2, 327.1, 366/330.3, 330.5, 330.1–330.7; 416/243
See application file for complete search history.

(56) References Cited

U.S. PATENT DOCUMENTS 4,896,971 A * 1/1990 Weetman ..... B01F 3/04531 261/77
5,595,475 A * 1/1997 Weiss ..... B01F 7/00341 416/223 R
5,813,837 A * 9/1998 Yamamoto ..... B01F 7/00341 366/270
5,951,162 A * 9/1999 Weetman ..... B01F 7/001 366/328.1
6,250,797 B1 * 6/2001 Weetman ..... B01F 3/04531 261/93
6,612,733 B2 * 9/2003 Schmidt ..... B01F 7/00208 366/292
7,168,641 B2 * 1/2007 Filgueiras ..... B03B 5/00 241/43
7,401,974 B2 * 7/2008 Himmelsbach ..... B01F 7/00341 366/330.3
2004/0228210 A1 * 11/2004 Himmelsbach ..... B01F 7/00275 366/330.3
2007/0268779 A1 * 11/2007 Himmelsbach ..... B01F 7/00341 366/330.3
2017/0197190 A1 * 7/2017 Keller ..... B01F 7/00016

FOREIGN PATENT DOCUMENTS

DE 299 23 600 U1 11/2000
DE 199 52 748 A1 5/2001
DE 203 06 759 U1 7/2003
EP 0 469 302 A1 2/1992

OTHER PUBLICATIONS

International Preliminary Report on Patentability dated Feb. 9, 2017 for the corresponding international application No. PCT/EP/2015/066315.
German Search Report dated Apr. 14, 2015 issued in the corresponding German Patent Application No. 10 2014 110 542.7 (and partial English translation).

* cited by examiner

STIRRING DEVICE

CROSS REFERENCE TO RELATED APPLICATIONS

This application is a U.S. national stage application of PCT/EP2015/066315 filed on Jul. 16, 2015, which is based on German Patent Application No. 10 2014 110 542.7 filed on Jul. 25, 2014, the contents of which are incorporated herein by reference.

STATE OF THE ART

The invention relates to a stirring device according to claim 1.

Stirring elements with a plurality of stirring blades for stirring, mixing, homogenizing, dispersing and/or suspending abrasive media are known.

The objective of the invention is, in particular, to make a stirring device available which has improved characteristics regarding wear-down. The objective is achieved by the features of patent claim 1, while advantageous implementations and further developments of the invention may be gathered from the subclaims.

ADVANTAGES OF THE INVENTION

A stirring device, in particular an axially conveying stirring device, for stirring, mixing, homogenizing, dispersing and/or suspending in particular abrasive media, in particular for ore processing, is proposed, with at least one stirring blade which is configured to rotate about a rotary axis, and with a contour unit which is in particular embodied differing from a coating and is configured for reducing wear-down, in particular reducing spalling and/or gliding wear, of the at least one stirring blade.

Advantageously the stirring device comprises a plurality of stirring blades, preferably stirring blades that are identical to each other, in particular at least two, preferably at least three and particularly preferably at least four stirring blades. By a "stirring device" is in particular, in this context, at least a portion and/or an assembly group to be understood, in particular a sub-assembly group, of a stirring element, in particular of an axially conveying stirring element. In particular, the stirring device may also comprise the entire stirring element, in particular the entire axially conveying stirring element. In particular, the stirring element is herein different from an impeller wheel and/or fan wheel, in particular for conveying air. The abrasive medium is preferably embodied as a suspension. Preferentially at least one liquid component of the suspension is implemented as an acid, in particular sulfuric acid. In particular, the abrasive medium has a major solid-matter load, in particular ores, in particular nickelous ores. In particular, the stirring device is herein embodied for processing such abrasive media, in particular by its specific shape and/or specific material.

The at least one stirring blade is in particular implemented at least substantially plate-like and is preferably at least partly, preferably at least to a major part and especially preferentially entirely made of an alloy and/or a metal, in particular stainless steel, duplex steel and/or advantageously titanium, in particular titanium of any grade, preferably at least grade 2 and maximally grade 12. The term "at least to a major part" is herein to mean in particular by at least 50%, preferably by at least 70% and particularly preferentially by at least 90%. Furthermore, an "at least substantially plate-like" implementation of an object is in particular to mean an implementation of the object in which a minimum rectangular cuboid, in particular imaginary rectangular cuboid, which just still encloses the object, has a largest edge which is at least twice as large, preferably at least five times as large and especially advantageously at least ten times as large as a shortest edge of the rectangular cuboid. In particular, at least one side of the at least one stirring blade which is in particular arranged in parallel to a smallest area of the rectangular cuboid, and/or at least one side of the at least one stirring blade, which is in particular arranged in parallel to a medium-size area of the rectangular cuboid, defines a stirring blade edge of the at least one stirring blade. Herein the at least one stirring blade may in particular comprise a plurality of stirring blade edges, in particular a stirring blade inner edge, a stirring blade outer edge, a stirring blade front edge and/or a stirring blade rear edge. Advantageously at least one stirring blade edge, in particular the stirring blade inner edge, the stirring blade outer edge, the stirring blade front edge and/or the stirring blade rear edge, comprises at least one sloped, multi-sloped, chamfered, multi-chamfered and/or preferentially rounded region and in particular a plurality of sloped, multi-sloped, chamfered, multi-chamfered and/or preferentially rounded regions. By a "stirring blade inner edge" is herein in particular a stirring blade edge to be understood which faces the rotary axis, in particular in an assembled state and/or in at least one operative state. By a "stirring blade outer edge" is in particular a stirring blade edge to be understood which faces away from the rotary axis, in particular in an assembled state and/or in at least one operative state. By a "stirring blade front edge" is furthermore in particular a stirring blade edge to be understood which faces in a rotary direction, in particular in an assembled state and/or in at least one operative state. By a "stirring blade rear edge" is in particular a stirring blade edge to be understood which faces away from the rotary direction, in particular in an assembled state and/or in at least one operative state. Further at least one side of the at least one stirring blade, which side is in particular arranged in parallel to a largest area of the rectangular cuboid, defines a suction side and/or a pressure side of the at least one stirring blade. Herein a "suction side" of the at least one stirring blade is in particular to mean a side which is in at least one operative state configured for suctioning at least one fluid and/or abrasive medium, in particular in a direction towards the at least one stirring blade and/or stirring element. Further a "pressure side" of the at least one stirring blade is in particular to mean a side which is in at least one operative state configured for pushing off at least one fluid and/or abrasive medium, in particular in a direction away from the at least one stirring blade and/or stirring element. Preferably, viewed from above, in particular in a viewing direction that is perpendicular to the pressure side and/or the suction side of the at least one stirring blade, the at least one stirring blade is embodied at least substantially rectangular and/or trapezoid-shaped, preferentially having at least one rounded stirring blade corner, advantageously having at least two, preferably having at least three and particularly preferably having four rounded stirring blade corners. Moreover an "at least substantially" rectangular and/or trapezoid-shaped object is in particular to mean an object differing from a rectangular and/or trapezoid-shaped object by maximally 40%, advantageously by maximally 30%, preferentially by no more than 20% and particularly preferably by no more than 10%. "Configured" is in particular to mean specifically designed and/or equipped. By an object being configured for a certain function is in particular to be understood that the object fulfills said certain function in at least one application state and/or operative state.

The stirring device may in particular further comprise at least one stirring element hub, which is in particular configured, in at least one operative state, to accommodate at least one agitator shaft and/or to be fixated to the at least one agitator shaft. Herein the at least one agitator shaft in particular defines the rotary axis. In particular, the at least one stirring element hub may be made at least partly, preferably at least to a major part and particularly preferably entirely of an alloy and/or a metal, in particular stainless steel, duplex steel and/or advantageously titanium. Advantageously the at least one stirring element hub is made of the same material as the at least one stirring blade. It is in particular conceivable that the at least one stirring element hub is embodied in a one-part implementation and/or in a multi-part implementation, in particular in a two-part implementation, preferably in a four-part implementation, especially preferentially with identical stirring element hub parts. In this case the at least one stirring element hub may be connected and/or fixated to the at least one agitator shaft in particular via an additional fixation unit, e.g. at least one flange. A "one-part implementation" is in this context in particular to mean connected at least by substance-to-substance bond. The substance-to-substance bond may be established, for example, by an adhesive-bonding process, an injection-molding process, a welding process, a soldering process and/or another process that is deemed expedient by someone having ordinary skill in the art. Advantageously, however, a "one-part implementation" is to mean formed in one piece. Preferably said one piece is manufactured from a single blank and/or from a single cast. The at least one stirring element hub herein serves in particular for the purpose of directly and/or indirectly fixating the at least one stirring blade. Preferably the at least one stirring blade is in an assembled state arranged on the at least one stirring element hub in such a way that, at least in a viewing direction that is perpendicular to the rotary axis and/or in a direction of the stirring blade outer edge, the at least one stirring blade and/or the stirring blade outer edge of the at least one stirring blade includes an angle, in particular a blade angle, between 5° and 85°, preferably between 10° and 80° and especially preferentially between 15° and 75° with the rotary axis and/or with a rotary plane.

By a "contour unit" is in particular to be understood, in this context, a geometrical unit and/or a shaping, in particular geometrical shaping, preferably of the at least one stirring blade, which is in particular arranged at, fixated to and/or at least partly in contact with at least one surface and/or at least one portion of the at least one stirring blade. Preferably the contour unit is configured to at least locally reduce, in particular substantially reduce, and/or prevent at least one pressure difference and/or eddy shedding between two portions of the stirring element, preferably of the at least one stirring blade, in particular between the pressure side and the suction side. In this the term "to substantially reduce" is to mean in particular a reduction by at least 10%, advantageously by at least 20%, preferably by at least 30% and particularly preferably by no less than 40%. Preferentially the contour unit and/or at least one element of the contour unit is herein arranged in an abrasion-prone place. By an "abrasion-prone place" is in particular, in this context, a place to be understood which preferably faces in the rotary direction and/or towards the at least one stirring element hub, in particular a part and/or a portion of the stirring element, preferably of the at least one stirring blade, the place being in a functional state exposed to increased wear, in particular relative other places of the stirring element. Preferentially the contour unit is arranged in such a way that the at least one stirring blade is free of sharp edges. In particular the contour unit comprises at least one element which is embodied differing from a wing end disc, a winglet and/or a fin. Preferably all elements of the contour unit are embodied differing from a wing end disc, a winglet and/or a fin.

Such an implementation allows making a stirring device available which has improved characteristics regarding wear-down, wherein it is advantageously possible to suppress a wear mechanism, in particular without a performance of the stirring element being affected. In this regard in particular a stirring device may be made available showing low abrasive wear-down effect, which is in particular due to spalling and/or sliding wear, even in case of abrasive media with a high-degree of solid-matter load and high agitation velocities, as a result of which a durability and/or service life of the stirring element may advantageously be increased. Thus in particular maintenance and replacement intervals of the stirring elements and down times may be substantially shortened. Moreover, by means of an optimized geometry of the stirring element operative periods, in particular of stirring, mixing, homogenizing, dispersing and/or suspending, may be shortened and costs may be advantageously reduced.

The contour unit may be connected to the at least one stirring blade in a force-fit and/or form-fit fashion. Preferably, however, the contour unit is embodied at least partly in a one-part implementation with the at least one stirring blade. The term "at least partly in a one-part implementation" is in particular to mean, in this context, that at least one element of the contour unit and/or the contour unit is embodied in a one-part implementation with at least one stirring blade element of the at least one stirring blade and/or with the at least one stirring blade. In this way in particular a stable and secure connection may be established. Moreover, in particular structural components may be reduced, wherein contiguous transitions may be advantageously created between the contour unit and the at least one stirring blade, as a result of which in particular potential eddy-generating points are advantageously reducible.

In case the contour unit comprises at least one contour curvature element, which is embodied by a curved portion, in particular a folded-down and/or advantageously bent portion of the at least one stirring blade, and which has a smaller bending radius with respect to at least one stirring blade curvature of the at least one stirring blade, then the at least one stirring blade may advantageously be implemented in such a way that an eddy shedding can be minimized and/or entirely suppressed.

In particular, the at least one stirring blade may be embodied in a planar fashion. In this case a bending radius of the at least one stirring blade curvature of the at least one stirring blade is infinite. Herein the at least one stirring blade preferably has at least one stirring blade curvature with a bending radius between zero and infinite. Especially preferentially the at least one stirring blade curvature herein has a bending radius with a value between 20% and 80%, preferably between 25% and 60% and particularly preferably between 30% and 40% of a stirring element diameter of the stirring element. In this context, a "stirring element diameter" is in particular to mean a diameter of a smallest imaginary circle which just entirely encompasses the stirring element. The at least one stirring element curvature is in this case preferably embodied in such a way that the pressure side of the at least one stirring blade features a concave curve and/or the suction side of the at least one stirring blade features a convex curve. Preferably the at least one stirring blade curvature features a bending axis and/or a curve axis which is preferentially at least substantially parallel to the stirring blade front edge and/or the stirring blade rear edge. "At least substantially parallel" is in particular to mean an orientation of a direction with respect to a reference direction, in particular in a plane, the direction differing from the reference direction in particular by less than 8°, advantageously by less than 5° and especially advantageously by less than 2°. Furthermore, a "smaller bending radius" is in particular to mean a bending radius which is smaller with respect to a reference bending radius by at least 1%, advantageously by at least 5%, preferably by no less than 10% and particularly preferably by no less than 20%.

It is also proposed that the at least one contour curvature element is curved in the same direction as the at least one stirring blade curvature, in particular towards the pressure side. In this way a continuous fluid flow, in particular of the abrasive medium, may be generated, which allows further reduction of eddy shedding.

If the at least one contour curvature element has a bending radius corresponding to a value between 3% and 35%, preferably between 5% and 15% of a stirring element diameter, in particular of the stirring element, a geometric implementation may be optimized and in particular signs of abrasive wear may be further reduced.

In a preferred implementation of the invention it is proposed that the at least one contour curvature element is at least substantially arranged on a stirring blade front edge of the at least one stirring blade and/or on a stirring blade outer edge of the at least one stirring blade. By an object being arranged "at least substantially" on a stirring blade edge is in particular to be understood that the object is arranged in a proximity of the respective stirring blade edge. Particularly preferably the at least one contour curvature element is herein arranged in a region, preferably a proximity, of a stirring blade corner, in which in particular the stirring blade front edge meets the stirring blade outer edge. By a "proximity" is in particular a spatial region to be understood the points of which differ from a reference point by maximally 10%, preferably by maximally 5% and especially preferentially by maximally 1% of a stirring element diameter. This in particular allows further optimizing a geometric implementation of the stirring element in a simple manner.

It is further proposed that the at least one contour curvature element comprises a bending axis and/or curve axis which includes, in a viewing direction along the rotary axis, angles between 15° and 75°, preferably between 20° and 50°, with the stirring blade front edge of the at least one stirring blade, in a rotary direction of the at least one stirring blade subsequently to a stirring blade front edge. The term "in a rotary direction of the at least one stirring blade subsequently to the stirring blade front edge" is in particular to mean, in this context, in a region of the stirring element which is in particular free of the at least one stirring blade. This allows further smoothing of a fluid flow and thus reduction of eddy shedding.

Furthermore it is proposed that the contour unit comprises at least one contour edge element which is at least partly, preferably at least to a major part and particularly preferably entirely implemented by a stirring blade outer edge of the at least one stirring blade, and which is embodied, at least in a viewing direction in parallel to the rotary axis, along a circumferential direction, at least substantially circular-arc-shaped, with a center point of the circular arc being located on the rotary axis. In this context, the term "at least substantially circular arc-shaped" is in particular to mean an object which differs from a circular arc shape by no more than 20%, advantageously by maximally 10%, preferably by no more than 5% and particularly preferably by maximally 1%. In this case the at least one contour edge element and/or the stirring blade outer edge of the at least one stirring blade describes and/or defines, in a full turn of the stirring blade, in particular a circle, in particular in a viewing direction that is parallel to the rotary axis. In particular, the stirring element is in this case embodied concentrically, in particular entirely concentrically. This in particular allows achieving a particularly uniform flow behavior, thus advantageously reducing wear-down.

The at least one stirring blade may be fastened to the at least one stirring element hub in particular directly and/or indirectly. Preferentially; however, the contour unit comprises at least one, preferably precisely one blade connection element, which connects the at least one stirring blade to the at least one stirring element hub. The at least one blade connection element is in particular free of sharp edges. The at least one blade connection element is furthermore preferably embodied in a one-part implementation with the at least one stirring blade and/or with the at least one stirring blade hub. Alternatively, however, it is also conceivable that the at least one blade connection element is embodied as a blade holding element and is, in particular in an assembled state, connected to the at least one stirring blade and/or to the at least one stirring blade hub at least partly and/or entirely in a force-fit and/or form-fit manner, e.g. in particular via a screw connection and/or a plug connection. Advantageously the at least one blade connection element is herein embodied at least partly, preferably at least to a major part and particularly preferably entirely of an alloy and/or a metal, in particular stainless steel, duplex steel and/or advantageously titanium. Especially preferentially the at least one blade connection element is made of the same material as the at least one stirring blade and/or the at least one stirring element hub. In this way an advantageously eddy-shedding free connection of the at least one stirring blade to the at least one stirring element hub is achievable.

Preferably the at least one blade connection element includes an angle with the rotary axis between 10° and 80°, preferably between 30° and 80° and particularly preferably between 50° and 80°. In this case the at least one stirring blade is preferably arranged on and/or connected to the at least one blade connection element in such a way that the at least one stirring blade includes the same angle with the rotary axis as the at least one blade connection element. Alternatively, however, it is also conceivable that the at least one stirring blade is arranged on and/or connected to the at least one blade connection element that the at least one stirring blade includes an angle with the rotary axis which differs from the at least one blade connection element. It is in particular conceivable that the at least one blade connection element includes an angle of 90° with the rotary axis. In this case the at least one stirring blade could in particular be arranged in such a way that the at least one stirring blade includes an angle with the rotary axis between 10° and 80°, preferably between 30° and 80° and particularly preferably between 50° and 80°. This allows optimizing a pitch angle of the at least one stirring blade as well as further reducing wear-down.

The at least one blade connection element may be embodied as any kind of blade connection element that is deemed expedient by a person having ordinary skill in the art, in particular as a blade holding element. Preferentially, however, the at least one blade connection element is embodied at least substantially as a rod-shaped bar, wherein a material thickness decreases towards a stirring blade outer edge of the at least one stirring blade. In this context, the term "at least substantially as a rod-shaped bar" is in particular to mean an implementation of an object which differs from a rod-shaped bar by a volume portion of maximally 50%, preferably no more than 30% and particularly preferably maximally 10%. In this case the at least one blade connection element is in particular arranged in such a way that a main extension direction of the at least one blade connection element runs at least substantially in parallel to a stirring blade front edge and/or to a stirring blade rear edge. By a "main extension direction" of the at least one blade connection element in particular a direction is to be understood which is perpendicular to a base surface of a smallest geometric cylinder, in particular imaginary cylinder, which just still entirely encloses the at least one blade connection element. In this way in particular a flow behavior of the abrasive medium can be further optimized.

In a preferred implementation of the invention it is proposed that the at least one blade connection element extends at least substantially in parallel along a stirring blade front edge of the at least one stirring blade. In particular, the at least one blade connection element is herein arranged in such a way that the at least one blade connection element ends flush with the stirring blade front edge of the at least one stirring blade. This in particular allows advantageously reducing and/or preventing potential eddy shedding.

Furthermore a system is proposed, in particular an ore-processing system, with at least one container, in particular pressure container, preferably an autoclave, which is in particular arranged horizontally, in particular for the purpose of accommodating an abrasive medium, and with at least one stirring device which is arranged in the at least one container. Preferentially the stirring device herein has a rotary axis, which is in particular arranged perpendicularly to a container axis, in particular a horizontally arranged container axis, and/or to the container. The system may in particular comprise a plurality of stirring devices, wherein at least two and/or at least three stirring devices may be arranged and/or fixated side by side, each on a separate agitator shaft, in particular in at least one operative state, and/or may be arranged and/or fixated one above the other on a agitator shaft, in particular a common agitator shaft, in particular in at least one operative state. Furthermore, dividing walls, in particular partially permeable, in particular fluid-permeable, in particular horizontally and/or vertically arranged dividing walls may be arranged in particular between the respective stirring devices, as a result of which in particular a continuous agitating process is achievable. The system may in particular comprise at least one dividing wall and/or the abrasive medium, which is in particular situated in the container. This in particular allows making available a long-lived system, in particular for ore processing, which is optimized, in particular regarding potential eddy shedding and/or wear-down, the system having improved characteristics as regards a service life, a maintenance interval and/or a replacement interval. Moreover the specific implementation of the stirring device allows supplying a stirring element which is advantageously adapted to a geometry of the container, as a result of which in particular container corners and/or container rims may also be reached in an advantageously simple fashion.

The stirring device is herein not to be limited to the application and implementation described above. In particular, the stirring device may, for fulfilling a functionality herein described, comprise a number of respective elements, structural components and units that differs from a number herein mentioned.

DRAWINGS

Further advantages will become apparent from the following description of the drawings. The drawings show an exemplary embodiment of the invention. The drawings, the description and the claims contain a plurality of features in combination. The person having ordinary skill in the art will purposefully also consider the features separately and will find further expedient combinations.

Figure 2:
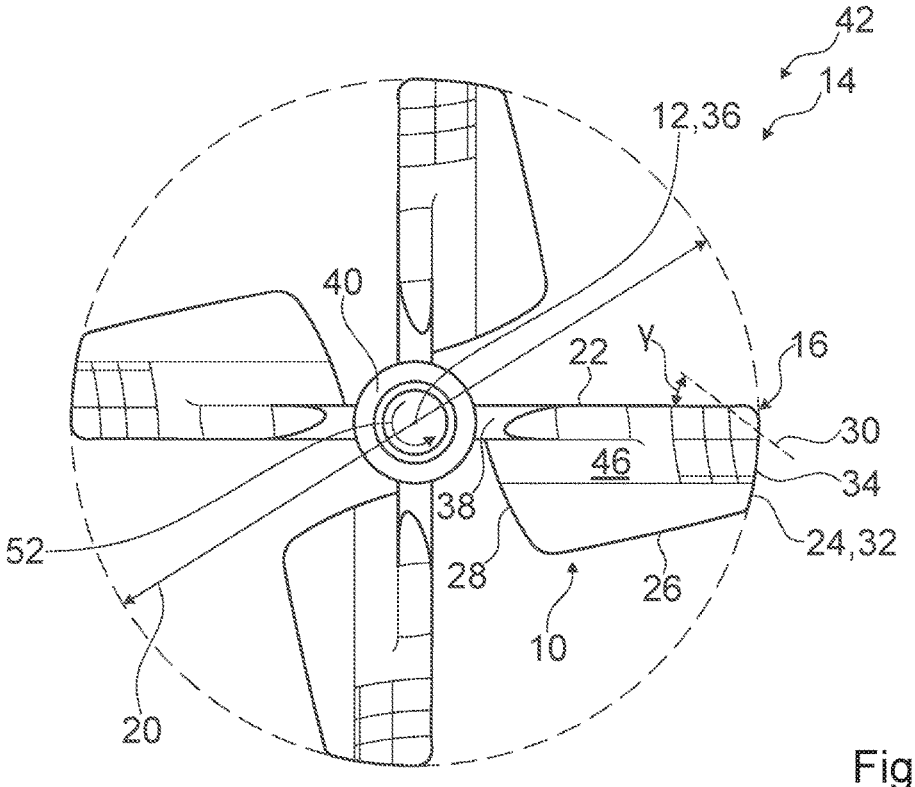
Figure 3:
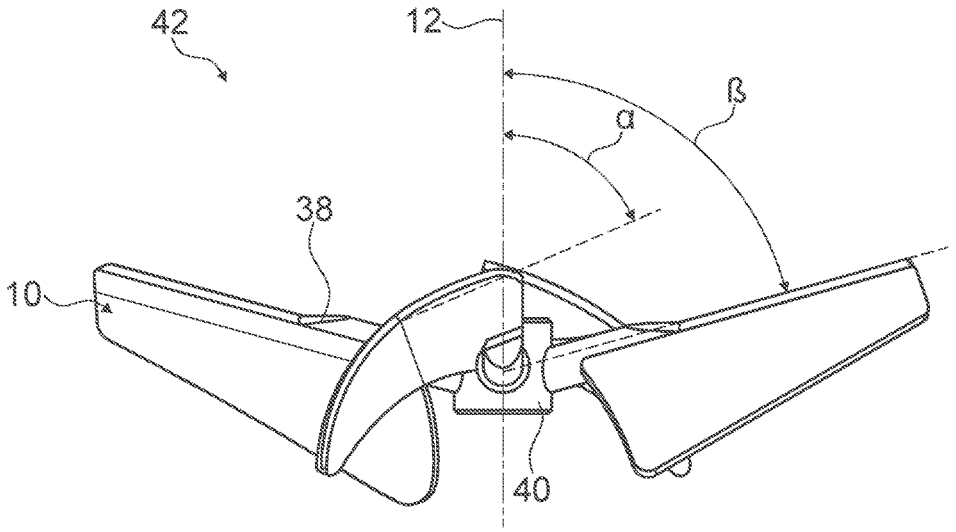
Figure 4:
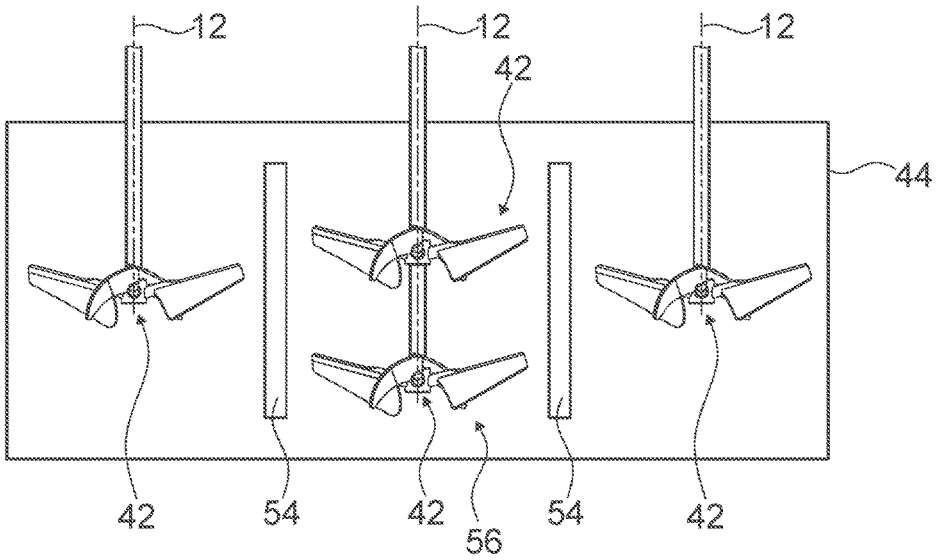

It is shown in:

FIG. 1 a stirring element embodied as an axial agitator with a stirring device, in a perspective view, FIG. 2 the stirring element in a view from above, FIG. 3 the stirring element in a lateral view, and FIG. 4 a system with a container and with a plurality of identical stirring elements of FIGS. 1 to 3.

DESCRIPTION OF THE EXEMPLARY EMBODIMENT

FIGS. 1 to 3 show a stirring element 42, which is embodied as an axial agitator, in a fully assembled state in a perspective view (cf. FIG. 1), in a view from above (cf. FIG. 2) and in a lateral view (cf. FIG. 3). The stirring element 42 comprises in the present case an axially conveying stirring device. The stirring device is intended for stirring, mixing, homogenizing, dispersing and/or suspending abrasive media, in particular fluids and/or solid matters. In the present case the stirring device is made entirely of grade 12 titanium.

The stirring device comprises a stirring element hub 40. The stirring element hub 40 is in the present case embodied in a one-part implementation. As an alternative, it is however also conceivable to implement a stirring element hub in a multi-part implementation. The stirring element hub 40 is configured for accommodating a agitator shaft (not shown) in at least one operative state. The stirring element hub 40 is configured for mounting the stirring device to the agitator shaft axially. An orientation of the agitator shaft defines a rotary axis 12 of the stirring device.

The stirring device moreover comprises four stirring blades 10. For the sake of a better view, only one of the stirring blades 10 is provided with reference numerals in FIGS. 1 to 3. The stirring blades 10 are embodied identically. The stirring blades 10 are fixated to the stirring element hub 40 indirectly. The stirring blades 10 are arranged spaced apart from the stirring element hub 40. The stirring blades 10 are arranged at 90° angular distances from each other. The stirring blades 10 are arranged on the stirring element hub 40 in such a way that the stirring blades 10 include an angle $\alpha$ of approximately 45° with the rotary axis 12 (cf. in particular FIG. 3). Alternatively it is also conceivable to fixate the stirring blades to a stirring element hub directly. A stirring device could also comprise three stirring blades, which are in particular arranged at 120° angular distances from each other, and/or two stirring blades, which are in particular arranged at 180° angular distances from each other. In the following only one implementation of one of the stirring blades 10 is described, wherein the description may be applied to the other stirring blades 10, which are in particular embodied identically to each other.

The stirring blade 10 is embodied plate-like. The stirring blade 10 has an at least substantially constant material thickness. Viewed from above, the stirring blade 10 is embodied at least substantially rectangular (cf. in particular FIG. 2). Furthermore the stirring blade 10 comprises, viewed from above, four rounded stirring blade corners. The stirring blade 10 comprises a stirring blade front edge 22, a stirring blade outer edge 24, a stirring blade rear edge 26 and a stirring blade inner edge 28. All edges of the stirring blade front edge 22, the stirring blade outer edge 24, the stirring blade rear edge 26 and the stirring blade inner edge 28 are rounded. The stirring blade 10 also comprises a suction side 46 as well as a pressure side 48, which is situated opposite the suction side 46. Moreover the stirring blade 10 comprises a stirring blade curvature 18. The stirring blade curvature 18 corresponds to a first cambering of the stirring blade 10. A bending radius of the stirring blade curvature 18 corresponds to approximately 36% of a stirring element diameter 20. The stirring element curvature 18 has in the present case a bending axis 50, which is arranged in parallel to the stirring blade front edge 22. The stirring blade curvature 18 is curved towards the pressure side 48. In the present case the stirring blade 10 comprises a concave pressure side 48 and a convex suction side 46.

The stirring blade 10 is configured to rotate about the rotary axis 12 for the purpose of homogenizing and/or dispersing an abrasive medium, in particular a suspension of sulfuric acid and nickelous ore. The stirring blade front edge 22 herein faces toward a rotary direction 52. For the purpose of reducing wear-down of the stirring blade 10 and of lengthening a service life of the stirring element 42, the stirring device herein comprises at least one contour unit 14. In the present case the stirring device comprises four contour units 14, which are embodied identically to each other. Each contour unit 14 is allocated to one of the stirring blades 10. In the following the description is limited to only one of the contour units 14.

The contour unit 14 comprises a contour curvature element 16. The contour curvature element 16 is implemented by a curved portion of the stirring blade 10. The contour curvature element 16 is implemented as a geometric shaping of the stirring blade 10. The contour curvature element 16 is thus embodied in a one-part implementation with the stirring blade 10. The contour curvature element 16 corresponds to a second cambering of the stirring blade 10. The contour curvature element 16 is arranged in an abrasion-prone place. In the present case the contour curvature element 16 is arranged in a proximity of the stirring blade corner in which the stirring blade front edge 22 and the stirring blade outer edge 24 meet. The contour curvature element 16 has a bending radius. The bending radius of the contour curvature element 16 is smaller than the bending radius of the stirring blade curvature 18. The bending radius of the contour curvature element 16 corresponds in the present case to 10% of the stirring element diameter 20. Further the contour curvature element 16 has a bending axis 30, which includes, in a viewing direction along the rotary axis 12, an angle $\gamma$ of approximately 30° with the stirring blade front edge 22 of the stirring blade 10. In the present case the contour curvature element 16 is curved in the same direction as the stirring blade curvature 18.

The contour unit 14 moreover comprises a contour edge element 32. The contour edge element 32 is implemented by the stirring blade outer edge 24 of the stirring blade 10. The contour edge element 32 is embodied as a geometric shaping of the stirring blade 10. The contour edge element 32 is thus embodied in a one-part implementation with the stirring blade 10. The contour edge element 32 is arranged in an abrasion-prone place. In the present case the contour edge element 32 is embodied, at least in a viewing direction in parallel to the rotary axis 12, circular-arc-shaped along a circumferential direction 34, with a circular-arc center point 36 that is located on the rotary axis 12. The contour edge element 32 is embodied in such a way that the stirring blade outer edge 24 and/or the stirring element 42 describes a circle in an operative state. Herein the diameter of said circle equals the stirring element diameter 20.

Furthermore the contour unit 14 comprises a blade connection element 38. The blade connection element 38 is configured for connecting the stirring blade 10 to the stirring element hub 40. For this purpose the blade connection element 38 is fixated on the one hand to the stirring element hub 40 and on the other hand to the stirring blade 10. In the present case the blade connection element 38 is embodied in a one-part implementation with the stirring element hub 40. The blade connection element 38 is furthermore embodied in one-part implementation with the stirring blade 10. In the present case the stirring blade 10 is fixated to the blade connection element 38 centrally, in particular at half height of the blade connection element 38. Alternatively, however, any further fixation options are conceivable which are deemed expedient by someone skilled in the art. A blade connection element could also be entirely dispensed with, resulting in particular in a stirring blade being fixated to a stirring element hub directly. The blade connection element 38 is in the present case embodied as a rod-shaped bar. The blade connection element 38 extends in parallel along the stirring blade front edge 22. Herein the blade connection element 38 is arranged in such a way that the blade connection element 38 ends flush with the stirring blade front edge 22. In the present case the blade connection element 38 further includes with the rotary axis 12 an angle $\beta$ of approximately 75° (cf. in particular FIG. 3). The stirring blade 10 includes the same angle with the rotary axis 12. Hence the stirring blade 10 includes an angle of approximately 75° with the rotary axis 12.

Moreover a material thickness of the blade connection element 38 decreases towards the stirring blade outer edge 24. In the present case the blade connection element 38 comprises at least substantially four portions. In a first portion facing the stirring element hub 40 the blade connection element 38 is embodied cylinder-shaped. In the first portion a material thickness of the blade connection element 38 corresponds to a maximum material thickness of the blade connection element 38. The maximum material thickness approximately corresponds to a five-fold material thickness of the stirring blade 10. In a second portion, which in particular directly follows the first partial section, the blade connection element 38 tapers on a first side facing towards the suction side 46. Herein a material thickness of the blade connection element 38 decreases continuously, in particular linearly. At an end of the second portion the blade connection element 38 merges flush into the stirring blade 10. At the end of the second portion the material thickness of the blade connection element 38 approximately corresponds to a three-fold material thickness of the stirring blade 10. In a third portion, which in particular directly follows the second portion, the blade connection element 38 is embodied at least substantially half-cylinder shaped. In the third portion the material thickness of the blade connection element 38 approximately corresponds to a three-fold material thickness of the stirring blade 10. In a fourth portion, which in particular directly follows the third portion, the blade connection element 38 tapers on a second side which faces the pressure side 48. Herein a material thickness of the blade connection element 38 decreases continuously, in particular linearly. At one end of the fourth portion the blade connection element 38 merges flush into the stirring blade 10 on the second side. At the end of the fourth portion the material thickness of the blade connection element 38 corresponds to a minimum material thickness of the blade connection element 38. The minimum material thickness corresponds to the material thickness of the stirring blade 10.

FIG. 4 shows an exemplary system for ore-processing, with a container 44, which is embodied as an autoclave and is arranged horizontally, and with a plurality of stirring elements 42 arranged in the container 44. The container 44 is in the present case divided into three container regions by two fluid-permeable dividing walls 54. The stirring elements 42 are in the present case embodied identically. The stirring elements 42 correspond to the stirring element 42 of FIGS. 1 to 3. Each of the stirring elements 42 hence comprises a stirring device according to the invention. The stirring elements 42 are arranged in the container 44 in such a way that their respective rotary axis 12 is arranged perpendicularly to a horizontally arranged container axis. In the present case the system comprises four stirring elements 42. In a first container region a first stirring element 42 of the four stirring elements 42 is arranged. The first stirring element 42 is arranged on a first agitator shaft. In a second container region a multi-step agitator 56 is arranged. In the present case the multi-step agitator 56 comprises two steps. The multi-step agitator 56 comprises a second stirring element 42 of the four stirring elements 42 and a third stirring element 42 of the four stirring elements 42. The second stirring element 42 and the third stirring element 42 are arranged on second agitator shaft, in particular a common agitator shaft. In a third container region a fourth stirring element 42 of the four stirring elements 42 is arranged. The fourth stirring element 42 is arranged on a third agitator shaft. In an operative state, the abrasive medium (not shown) is arranged in the container 44. The abrasive medium is in the present case embodied as a suspension having a major solid-matter load. Alternatively it is also conceivable to arrange a differing number of stirring elements and/or differently arranged and/or differently implemented stirring elements, which may in particular comprise a stirring device according to the invention, in a container.

REFERENCE NUMERALS

10 stirring blade
12 rotary axis
14 contour unit
16 contour curvature element
18 stirring blade curvature
20 stirring element diameter
22 stirring blade front edge
24 stirring blade outer edge
26 stirring blade rear edge
28 stirring blade inner edge
30 bending axis
32 contour edge element
34 circumferential direction
36 circular-arc center point
38 blade connection element
40 stirring element hub
42 stirring element
44 container
46 suction side
48 pressure side
50 bending axis
52 rotary direction
54 dividing wall
56 multi-step agitator
α angle
β angle
γ angle

The invention claimed is:

1. An axially conveying stirring device, for stirring, mixing, homogenizing, dispersing and/or suspending, abrasive media, with at least one stirring blade, which is configured to rotate about a rotary axis, and with a contour unit, which is configured for reducing wear-down of the at least one stirring blade and which is embodied at least partly in a one-part-implementation with the at least one stirring blade, wherein the contour unit comprises at least one contour curvature element, which is implemented by a curved portion of the at least one stirring blade, a bending radius of the contour curvature element is smaller with respect to a further bending radius of a stirring blade curvature of a remaining portion of the at least one stirring blade, the at least one contour curvature element is curved in the same direction as the stirring blade curvature of the remaining portion, the contour unit comprises a first bending axis, which encloses a first angle with a stirring blade front edge, the stirring blade curvature of the remaining portion of the at least one stirring blade comprises a second bending axis, which encloses a second angle, which is different from the first angle, with the stirring blade front edge, the contour unit comprises at least one contour edge element, which is implemented at least partly by a stirring blade outer edge of the at least one stirring blade and is embodied, at least in a viewing direction in parallel to the rotary axis, along a circumferential direction at least substantially in a circular-arc shape, with a circular-arc center point being located on the rotary axis the bending radius of the contour curvature element is at least 5% smaller than the bending radius of the remaining portion of the stirring blade, and the bending radius of the contour curvature element corresponds to 10% of a stirring element diameter.

2. The stirring device according to claim 1, wherein the bending radius of the at least one contour curvature element is between 3% and 35% of a stirring element diameter.

3. The stirring device according to claim 1, wherein the at least one contour curvature element is arranged at least substantially on a stirring blade front edge of the at least one stirring blade and/or on a stirring blade outer edge of the at least one stirring blade.

4. The stirring device according to claim 1, wherein the at least one contour curvature element has a bending axis including, in a viewing direction along the rotary axis, an angle γ between 15° and 75° with the stirring blade front edge of the at least one stirring blade, subsequently to the stirring blade front edge in a rotary direction of the at least one stirring blade.

5. The stirring device according to claim 1, wherein the contour unit comprises at least one blade connection element, which connects the at least one stirring blade to at least one stirring element hub.

6. The stirring device according to claim 5, wherein the at least one blade connection element forms with the rotary axis an angle β between 10° and 80°.

7. The stirring device according to claim 5, wherein the at least one blade connection element is embodied at least substantially as a rod-shaped bar, a material thickness decreasing towards a stirring blade outer edge of the at least one stirring blade.

8. The stirring device according to claim 5, wherein the at least one blade connection element extends at least substantially in parallel along a stirring blade front edge of the at least one stirring blade.

9. The stirring device according to claim 5, wherein the at least one blade connection element is arranged in such a way that the at least one blade connection element ends flush with the stirring blade front edge of the at least one stirring blade.

10. A stirring element with the at least one stirring device according to claim 1.

11. A system with at least one container and with the at least one stirring device according to claim 1, which is arranged in the at least one container.

12. The stirring device according to claim 1, wherein the curvature of the stirring blade is contiguous.

13. The stirring device according to claim 1, wherein the curved portion of the stirring blade, which implements the curvature element, is contiguously curved.

14. The stirring device according to claim 1, wherein the contour curvature element is located only at a corner of the stirring blade where a front edge of the stirring blade meets an outer edge of the stirring blade.

15. The stirring device according to claim 1, wherein the contour curvature element is located only at a corner of the stirring blade where a front edge of the stirring blade meets an outer edge of the stirring blade.

16. The stirring device according to claim 1, wherein the stirring blade curvature features a bending axis and/or a curve axis which is at least substantially parallel to a stirring blade front edge and/or a stirring blade rear edge.

17. The stirring device according to claim 1, wherein the curvature of the contour curvature element and the stirring blade curvature of the remaining portion of the at least one stirring blade form a smooth, edge-free transition.

* * * * *